United States Patent [19]

Hackman et al.

[11] 4,334,573

[45] Jun. 15, 1982

[54] PET ACCESS DOOR KIT AND METHOD OF INSTALLATION

[76] Inventors: La Vona R. Hackman; James M. Hackman, both of 7816 Topia St., Long Beach, Calif. 90808

[21] Appl. No.: 71,754

[22] Filed: Aug. 31, 1979

[51] Int. Cl.[3] ..... E06B 7/28

[52] U.S. Cl. ..... 160/180; 160/DIG. 8

[58] Field of Search ..... 160/48, 63, 116, 179, 160/180, 219, 237, DIG. 8; 49/168

[56] References Cited

U.S. PATENT DOCUMENTS

| | | | |
|---|---|---|---|
| 697,106 | 4/1902 | Schofield | 160/237 |
| 1,294,879 | 2/1919 | Davis | 160/DIG. 8 |
| 1,630,344 | 5/1927 | Iligan | 160/237 |
| 1,704,157 | 3/1929 | Webber | 160/180 |
| 2,205,661 | 6/1940 | Kraft | 160/237 |
| 2,758,646 | 8/1956 | Johnson | 160/DIG. 8 |
| 2,854,072 | 9/1958 | Winnan | 160/180 |
| 3,251,399 | 5/1966 | Grossman | 160/180 |
| 3,985,174 | 10/1976 | Briker | 160/180 |
| 4,053,007 | 10/1977 | Griffith | 160/180 |

*Primary Examiner*—C. J. Husar
*Assistant Examiner*—Cherney S. Lieberman
*Attorney, Agent, or Firm*—Fulwider, Patton, Rieber, Lee & Utecht

[57] ABSTRACT

A pet access door kit and method of installation in a screen door. The kit includes members attachable to the door screen to define a generally rectangular screen section adjacent a lower corner of the screen door. The screen material is cut within the defined area except for the upper extremity of the section, to form a screen flap, the upper extremity of the flap constituting a hinge portion. A suitable weight is attachable to the lower extremity of the flap to maintain it in closed position.

2 Claims, 4 Drawing Figures

PET ACCESS DOOR KIT AND METHOD OF INSTALLATION

BACKGROUND OF THE INVENTION

1. Field of the Invention

A number of prior art pet access doors are available which can be incorporated in screen doors or the like to permit small pets such as dogs and cats to enter and leave a residence without human assistance, and which are effective to close off the interior of the residence from insects when the pet access door is not in use.

One type of pet access door is disclosed in U.S. Pat. Nos. 3,464,158 and 3,811,224. It typically comprises a vertical panel which is insertable in the open space formed between a partially open sliding glass door and the adjacent door frame. A pivoted lower portion of the panel constitutes the access door for pet use. A disadvantage of this type of pet door is that it is relatively expensive since it must be tailored to the dimensions of the particular door. Most door frames and doors are not of the same dimensions and obtaining a proper size pet access door at a reasonable cost is therefore a problem.

Another type of prior art door is shown in U.S. Pat. Nos. 3,690,299 and 4,053,007. This type of door is prefabricated and designed to be fitted within a precisely dimensioned opening in the door of a residence or the like. For example, in the structure of U.S. Pat. No. 4,053,007 rail and stile portions must be precisely dimensioned to fit the door and must be accurately aligned with the hinge points of the pet access door. The rail must be cut to the exact width of the particular door, and care must be exercised to insure proper pivoting action. Most of the pet access doors of the prior art similarly require more expertise to install than is desirable for the average householder.

SUMMARY OF THE INVENTION

According to the present invention, the screening of the usual screen door itself provides the material for the pet access door. A kit to accomplish this includes a pair of L-shape members adapted to rest against opposite sides of the screen for attachment in confronting relation at a lower corner of the door. Each member includes a rail portion for abutment against the door stile and a stile portion for abutment against the door rail. After installation of these members, two vertical cuts are made, one along the door stile and one along the stile portions of the L-shaped members. A third, horizontal cut is next made along the rail member, thereby defining a generally rectangular flap which is pivotable about its upper extremity. Suitable weight means can be attached to the lower extremity of the flap to maintain it in a closed position.

Thus, according to the present method, the usual screen door can be provided with a pet access door by attaching members on opposite sides of the screen at a lower corner of the door to define generally rectangular pet access section, and making cuts in the screen to convert it into a door flap.

Other objects and features of the present invention will become apparent from consideration of the following detailed description taken in connection with the accompanying drawings.

DESCRIPTION OF THE PREFERRED EMBODIMENT

Figure 1:
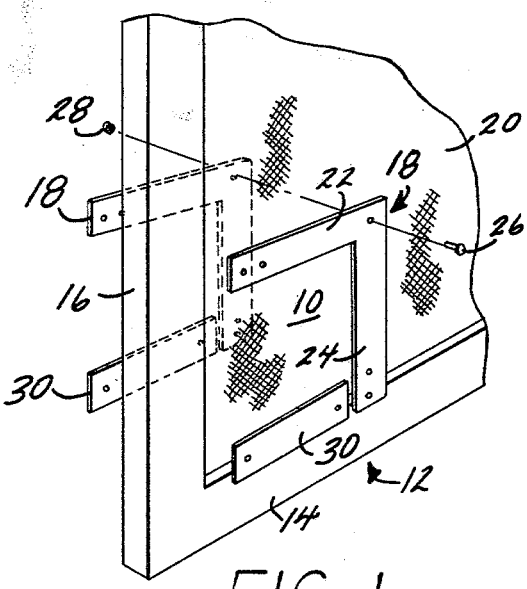
FIG. 1 is a perspective view of the present pet access door kit installed in a usual screen door, the components of the kit being shown in shaped, spaced apart, exploded relation prior to attachment to the screen.
Figure 2:
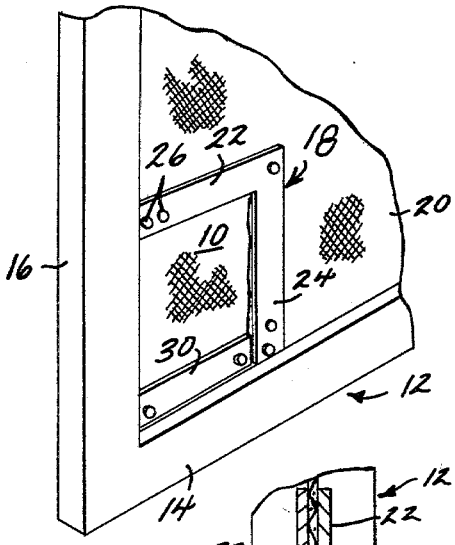
FIG. 2 is a view similar to FIG. 1 but illustrating the components attached together, with the pet access door formed by cutting the screen to define a generally rectangular pet access door.
Figure 3:
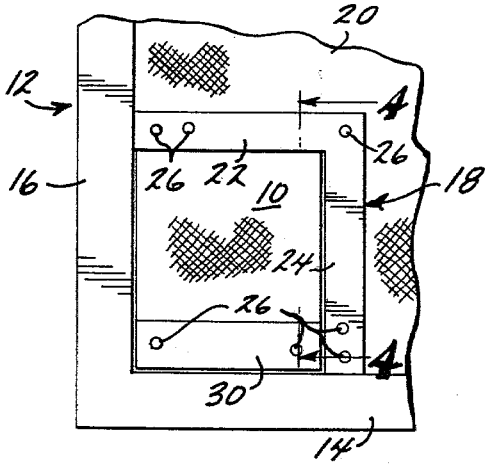
FIG. 3 is a front elevational view of the pet access door of FIG. 2.

Referring now to the drawings, there is illustrated a pet access door 10, according to the present invention, installed in a usual residential screen door 12 having a horizontal lower rail 14 and an adjacent vertical stile 16 which intersects the rail 14.

The door 12 is constructed of a kit comprising a pair of L-shaped members 18 adapted to rest against opposite sides of the screen 20 of the screen door 12, each member 18 having a horizontal rail portion 22 adapted to abut at its free end against the stile 16. Each member 18 further includes a stile portion 24 adapted to abut at its free end against the rail 14.

Figure 4:
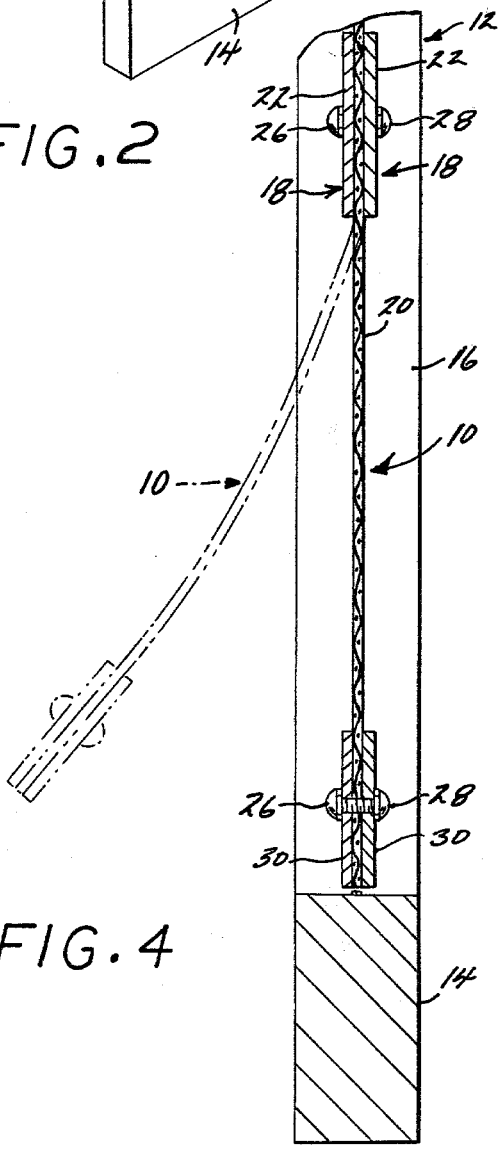
FIG. 4 is an enlarged view taken along the line 4—4 of FIG. 3, illustrating in phantom outline the position of the pet access door in its open position.

The pet access door kit further includes means for attaching together the pair of members 18 with the screen 20 sandwiched therebetween, the means in the present embodiment taking the form of a plurality of threaded bolts 26 passing through suitable aligned holes in the members 18 and the screen 20, and threadably engaged by a plurality of complemental nuts 28, as best seen in FIG. 4.

Although not critical to the present invention, a pair of confronting, elongated horizontal weight members 30 are preferably attached to the lower extremity of the screen section defined by the rail 14, stile 16, rail portion 22, and stile portion 24, for a purpose which will become evident.

The access door 12 is formed by utilizing a sharp knife or the like to make two vertical cuts in the screen 20, between the rail 14 and the rail portion 22, one along a line adjacent and parallel to the stile 16, and the other along a line adjacent and parallel to the stile portion 24. A third cut is made, between the stile 16 and the stile portion 24 along a line parallel to the rail 14. This intersects the previously made vertical cuts to provide a generally rectangular access flap which defines the door 10, and which is constituted of the material of the screen 20.

A pet wishing to pass from one side of the screen door 12 to the other simply pushes against the flap-like access door 10. This moves it from the full line position to the phantom line position illustrated in FIG. 4.

The access door 10 is constrained to hang in a generally vertical or closed position by the weight members 30, which are attached together against the screen 20 by bolts and nuts 28 in the same manner as the attachment of the L-shaped members 18.

From the foregoing, it will be seen that a pet access door kit is provided which, by utilizing the method of the present invention, enables easy modification of the usual screen door 12 to incorporate a pet access door 10. No measuring or fitting is required. All the pet owner need do is attach the L-shaped members 18 on opposite sides of the screen, make two vertical cuts in the screen along the stile 16 and the stile portion 24, and make a third horizontal cut along the rail 14, thereby forming the flexible screen flap which defines the door 10.

The L-shape members 18 need only be made large enough to accommodate the particular pet, and there is no need to individually dimension the components of the present pet door 10 to suit various sizes and configurations of screen doors. Moreover, there is no need to provide relatively complex and critically dimensioned pivot points for a pre-fabricated pet access door. Instead, as previously indicated, the door 10 utilizes the material of the screen 20 itself to provide the hinge portion.

The radius of bending of the upper extremity of the pet access door 10 is sufficiently great that the material of the screen 20 is not fatigued to any significant extent whereby it is characterized by a relatively long service life.

The joints or lines of separation between the screen material of the access door 10 and the screen 20 relatively rigidly held by the adjacent rail and stile portions of the door 12 and members 18 are automatically complementally and closely fitted, since one screen section was cut out of the other, thereby tending to exclude insects and wind borne debris.

Various modifications and changes may be made with regard to the foregoing detailed description without departing from the spirit of the invention.

We claim:

1. A screen door including a pet access door, said screen door comprising:

a finely apertured screen;

a horizontal lower rail;

a vertical stile intersecting said rail;

a pair of L-shape members engaged upon opposite sides of said screen in confronting relation, each of said members having a rail portion abutting at its free end against said stile without attachment thereto, and a stile portion abutting at its free end against said rail without attachment thereto;

means attaching said pair of members together, said screen being vertically cut along a line adjacent and parallel to said stile and along a line adjacent and parallel to said stile portion, and horizontally cut along a line adjacent and parallel to said rail, whereby a generally rectangular access flap is defined in which the screen of said access flap forms said pet access door and the screen at the upper horizontal extremity of said flap constitutes a hinge portion enabling pivotal movement of said flap between an open and a closed position; and weight means attached to the lower extremity of said flap and tending to orient said flap in said closed position.

2. A screen door according to claim 1 wherein said weight means comprises a pair of elongated members adapted to rest against opposite sides of said screen in confronting relation at the lower extremity of said flap, and means for attaching said weight members together.

* * * * *